US012043422B2

(12) United States Patent
Everwand et al.

(10) Patent No.: US 12,043,422 B2
(45) Date of Patent: Jul. 23, 2024

(54) APPARATUS FOR FILLING BULK GOODS INTO OPEN-MOUTH BAGS

(71) Applicant: HAVER & BOECKER OHG, Oelde (DE)

(72) Inventors: Torsten Everwand, Wadersloh (DE); Heiner Larssen, Steinfurt (DE); Robert Henke, Oelde (DE)

(73) Assignee: HAVER & BOECKER OHG, Oelde (DE)

( * ) Notice: Subject to any disclaimer, the term of this patent is extended or adjusted under 35 U.S.C. 154(b) by 0 days.

(21) Appl. No.: 16/464,481

(22) PCT Filed: Dec. 8, 2017

(86) PCT No.: PCT/EP2017/081988
§ 371 (c)(1),
(2) Date: May 28, 2019

(87) PCT Pub. No.: WO2018/104509
PCT Pub. Date: Jun. 14, 2018

(65) Prior Publication Data

US 2019/0322395 A1 Oct. 24, 2019

(30) Foreign Application Priority Data

Dec. 8, 2016 (DE) ..... 102016123810.4

(51) Int. Cl.
*B65B 1/04* (2006.01)
*B65B 1/28* (2006.01)
(Continued)

(52) U.S. Cl.
CPC ..... *B65B 1/04* (2013.01); *B65B 1/28* (2013.01); *B65B 43/54* (2013.01); *B65B 57/00* (2013.01)

(58) Field of Classification Search
CPC .. B65B 1/04; B65B 1/28; B65B 43/26; B65B 43/54; B65B 57/00
See application file for complete search history.

(56) References Cited

U.S. PATENT DOCUMENTS 2,133,367 A * 10/1938 Wagner ..... B65B 43/26 53/374.3
2,443,182 A * 6/1948 Carter ..... B65B 1/28 141/93

(Continued)

FOREIGN PATENT DOCUMENTS

CN 2841503 Y 11/2006
CN 200978011 Y 11/2007

(Continued)

*Primary Examiner* — Thomas M Wittenschlaeger
*Assistant Examiner* — David G Shutty
(74) *Attorney, Agent, or Firm* — Pearne & Gordon LLP; Bryan M. Gallo

(57) ABSTRACT

The invention relates to a device (1) for filling open bags (2) with powdery food, comprising a support structure (3) and a filling spout (4) accommodated on the support structure (3), on which a bag (2) to be filling is suspended. The bag (2) is maintained on the filling spout (4) by means of a bag holder (5, 6). The support structure (3) comprises a hollow profile (10, 11) with a control component (20) accommodated therein in order to protect against soiling. The hollow profile (10) comprises an air outlet (8) for controlling, in the hollow profile (10) when in operation an air pressure higher than the environment.

20 Claims, 4 Drawing Sheets

(51) Int. Cl.
*B65B 43/54* (2006.01)
*B65B 57/00* (2006.01)

(56) References Cited

U.S. PATENT DOCUMENTS 2,634,894 A * 4/1953 Fischer ..... B65B 1/28 141/148
2,942,761 A * 6/1960 Jungmayr ..... B65B 1/12 141/147
6,142,169 A * 11/2000 Lees ..... B08B 9/0325 222/64
6,918,417 B2 * 7/2005 Bernhard ..... B67C 3/244 141/85
7,104,033 B2 * 9/2006 Krulitsch ..... B67C 3/004 53/167
7,278,451 B2 * 10/2007 Cavallari ..... B67C 3/242 141/253
7,690,171 B2 4/2010 Merusi
10,118,721 B2 * 11/2018 Niehr ..... B67C 3/22
2008/0178558 A1 7/2008 Merusi
2011/0109018 A1 * 5/2011 Parrinello ..... B29C 49/28 264/509
2017/0275032 A1 9/2017 Vollenkemper et al.
2018/0002841 A1 * 1/2018 Vanheesbeke ..... D03C 3/28

FOREIGN PATENT DOCUMENTS

CN 101146714 A 3/2008
CN 203664331 U 6/2014
DE 75336 12/1970
DE 2529859 5/1982
DE 3640520 6/1988
DE 29803070 11/1998
DE 10346881 A1 5/2005
DE 202009000927 4/2009
DE 102014113859 3/2016
DE 102015223525 11/2016
ES 2567476 T3 * 11/2015 ..... B65B 43/46
GB 2219269 A * 12/1989 ..... B65B 7/08
JP 2009029497 A 2/2009
WO 2006102921 A1 10/2006

* cited by examiner

APPARATUS FOR FILLING BULK GOODS INTO OPEN-MOUTH BAGS

FIELD OF THE INVENTION

The present invention relates to an apparatus for filling bulk goods into bags and in particular for filling powdery foodstuffs into open-mouth bags. Such an apparatus may be configured as an FFS system (Form-Fill-Seal) and may comprise a bag manufacture for manufacturing the bags intended for filling immediately on the apparatus for example from a tubular sheet.

DESCRIPTION OF RELATED ART

The invention is in particular employed for bagging powdery food or foodstuffs or other powdery products where high levels of hygienic standards must be met. Preferably baby food or its ingredients such as in particular powdered milk, dextrose, starch etc. are filled into open-mouth bags. The bagging of these foodstuffs and in particular baby food requires high and highest levels of hygienic standards to be met. Any bags filled with such foodstuffs should show the smallest possible amount if any of adhering dirt particles.

The "European Hygienic Engineering and Design Group" (EHEDG) is an association of a variety of institutes, companies and establishments which discuss and publish guidelines on manufacturing and packaging foodstuffs. According to the EHEDG guidelines the packaging of foodstuffs requires for conduits on the machines to be readily accessible and individually fastened adjacent to one another to enable ease of cleaning the entire system. This allows to meet high hygienic standards since contamination if any of the system is readily accessible and thus easily removable. Still, cleaning requires too much work. Another drawback is that the installed components must meet the high hygienic standards which increases manufacturing costs. Moreover the cables and conduits must be arranged uncovered adjacent to one another in cable ducts. This generates very wide cable and hose trays, impeding accessibility to the machine.

In the case of very high requirements these systems may be installed in protected rooms provided with access locks for the staff and supply and discharge locks e.g. for the film supply and filled bag discharge.

It is therefore the object of the present invention to provide an apparatus for filling bulk goods into bags and in particular for filling powdery foodstuffs into open-mouth bags which meets high levels of hygienic standards and provides for reduced cleaning work and/or involves reduced manufacturing costs.

This object is solved by an apparatus having the features of claim 1. Preferred specific embodiments of the invention are the subjects of the subclaims. Further advantages and features can be taken from the general description and the description of the exemplary embodiment.

SUMMARY OF THE INVENTION

An apparatus according to the invention serves to fill bulk goods into bags and in particular to fill powdery foodstuffs or the like into open-mouth bags. The apparatus according to the invention comprises a support structure and accommodated on the support structure, at least one filling spout with a bag appended for filling and retained on the filling spout by means of at least one bag holder. The support structure comprises at least one hollow profile in which a control component is at least partially accommodated where it is protected from contamination. An air outlet is in particular provided in the hollow profile to apply on the hollow profile in operation an air pressure that is higher than in the ambience.

The apparatus according to the invention has many advantages. A considerable advantage of the apparatus according to the invention is that the support structure on which the bag is appended and retained during filling comprises at least one hollow profile. The hollow profile accommodates a control component that is protected from contamination. It is also possible for a number of control components to be protected when accommodated on and in particular in the hollow profile. The fact that the hollow profile encloses the control component or the control components prohibits the accretion of dirt particles on the control component. This considerably facilitates cleaning since the control component itself does not require cleaning. It is sufficient to clean the hollow profile, which in particular shows smooth walls, from the outside. Therefore the apparatus according to the invention does not need to be provided with connecting lines for air supply or electric connecting lines or the like disposed individually adjacent to one another to provide ease of cleaning but a plurality of conduits may be disposed even within the hollow profile as a wiring harness or the like. Thus, each individual conduit may be considered a control component.

An air outlet in the interior of the hollow profile may generate controlled excess pressure in the hollow profile so as to largely prevent the entry of particles or contaminants into the hollow profile. This eliminates the need to clean the hollow profile interior.

The hollow profile or at least one hollow profile is in particular sealed outwardly. Although "the hollow profile" will be discussed below, a number of hollow profiles may be provided and addressed, each comprising one or more control components in its interior.

The apparatus serves to fill bulk goods into bags. Particularly preferably the apparatus is used for filling powdery bulk goods and in particular foodstuffs into open-mouth bags. Preferably the open-mouth bags consist at least partially of a film. The bags are in particular manufactured from a tubular sheet. The bags (the term bag in the sense of the present invention always also includes an open-mouth bag) are preferably double-ply and peel off readily, so that after removing an outer layer, which may show contaminant particles, the inner layer protects the interior of the filled bag free of contaminants. Thus the outer layer may be removed following transport and prior to further processing.

In all the configurations the apparatus according to the invention may also be suitable for filling valve bags.

In all the configurations the hollow profile is particularly preferably outwardly sealed.

The hollow profile preferably accommodates at least one control component that is in particular a pneumatic control valve. It is also possible to dispose 2 or 3 or more control valves, which may be controlled separately, as control components in the hollow profile. The hollow profile may for example comprise at least one valve island including several (pneumatic) control valves as control components. The protected arrangement of the control valves in the interior of the hollow profile allows to use commercially available control valves for control components. These control valves do not have to comply with the raised hygienic standards which would have to be met outside of the hollow profile. This is another factor which reduces the (financial) overhead for manufacturing an apparatus according to the invention.

In preferred specific embodiments at least one control device is disposed or accommodated in the hollow profile. It is likewise preferred to dispose in the hollow profile at least one sensor device as the control component. Also, one or more connecting lines may be accommodated in the hollow profile. It may be an electric, pneumatic or hydraulic connecting line. It is also possible to accommodate electric and pneumatic connecting lines in the interior of the hollow profile.

It is likewise preferred to dispose at least one sensor cable in the hollow profile. This sensor cable may lead to a sensor inside the hollow profile. It is also possible to guide the sensor cable back out of the hollow profile. The sensor cable may be connected for example with a bag sensor, a pressure sensor, a location sensor, a position sensor, or a filling level sensor.

It is possible to dispose at least one sensor inside the hollow profile. For example a pressure sensor may be provided which captures a measurement of the pressure prevailing in the hollow profile. Then for example air may be introduced into the interior of the hollow profile controlled by the pressure sensor to prevent the pressure level from dropping beneath a predetermined pressure level. Preserving a specified excess pressure allows to very reliably prevent dust or contaminant particles from penetrating into the interior of the hollow profile.

In preferred specific embodiments and configurations the bag holder is fastened to the hollow profile respectively at least to one hollow profile. Preferably a number of bag holders are fastened to the hollow profile. When the bag holder is fastened to the hollow profile a supply line to the bag holder connecting- and/or control lines may simply run through the profile interior so as to reduce the number of surfaces likely to be contaminated outside the hollow profile. This reduces the cleaning overhead.

In preferred configurations the bag holder or at least one bag holder can be selectively controlled by (at least) one pneumatic cylinder and/or electrically. Pneumatically controlling the bag holder is simple and in particular with applications involving basically explosive materials a considerably lighter structure is conceivable since basically the inherent principle of pneumatic cylinders considerably reduces any risk of sparking.

Particularly preferably an air outlet pipe is connected with the pneumatic cylinder. The air outlet pipe of the pneumatic cylinder or of at least one pneumatic cylinder in particular opens into the interior of a hollow profile respectively the hollow profile. It is also possible for the air outlet pipe to comprise at least one outlet in at least one hollow profile. This configuration offers considerable advantages since venting the air out of the pneumatic cylinder into the hollow profile interior provides a certain amount of air supply so that the required excess pressure may optionally already be provided by the outlet air from the pneumatic cylinder.

Another advantage of such an air outlet pipe opening into the hollow profile interior is a reduction of air turbulences in the ambience of the apparatus so as to prevent the risk of contamination or dust from whirling up or to reduce these effects overall. Blowing off air to the ambience also causes considerable noise as a rule.

In particularly preferred configurations the apparatus comprises a rotating device including a plurality of bag holders disposed thereon.

An apparatus comprising a plurality of filling spouts (fastened to a rotating device) is preferably a rotary apparatus. The rotating device may comprise filling spouts disposed in a star pattern serving to receive one bag each. This allows to fill a number of bags simultaneously. It is also possible to successively control different stations during the rotation. A bag may be appended to a first station. In another station the bag may be filled in high speed flow. Further stations may follow where the bulk goods are filled into the bag in high speed flow or in low speed flow. The filling stations or separate intermediate stations may perform compaction of the filled bulk goods by means of compacting devices. Finally the bag is as a rule closed and conveyed off.

In all the configurations it is preferred for the support structure to comprise a plurality of hollow profiles. This applies in particular to apparatus comprising a rotating device. Then the rotating device may be formed by hollow profiles disposed in a star shape and rotatably supported for example on a central (vertical) hollow profile.

Preferably the rotating device comprises a central supporting unit configured as a hollow profile and a number of hollow profiles rotating relative to the supporting unit. The multiple rotary hollow profiles may be centrally interconnected and together may form a continuous structure with one shared hollow space or several, separate hollow spaces.

Preferably the central supporting unit which is configured as a hollow profile and can also be referred to as a supporting column or column, comprises a rotary bushing to the rotary hollow profile to enable the passage of one or more cables.

Preferably the central (vertical) hollow profile (also referred to as a supporting unit) comprises at least one bearing and/or at least one drive motor to dispose the rotary hollow profiles rotatable relative to the central supporting unit. The drive motor is preferably disposed in the central supporting unit configured as a hollow profile. This offers the advantage that the drive motor also does not need to meet the strict hygiene standards since it is accommodated and protected in the interior of the supporting unit and no dust can deposit thereon. The reduction or prevention of dust deposits in particular of organic materials generally reduces or prevents germ formation.

All the configurations including a rotating device may provide for accommodation of a slip ring and/or a compressed air manifold and/or a rotary compressed air bushing in the central hollow profile (supporting unit). A slip ring enables the transmission of electric signals from the central supporting unit to each of the hollow profiles for capturing signals or emitting control signals. A compressed air manifold allows to supply compressed air individually to pneumatic cylinders or the like. Moreover the compressed air supply may optionally serve to set and adjust the internal pressure in the hollow profiles.

In all the configurations the supporting unit or the central hollow profile is preferably connected with a supply station through at least one duct configured as a hollow profile (sealed and approximately or substantially horizontal). This enables protected accommodation of compressed air and/or vacuum lines and/or current-carrying lines such as sensor cables, or power supply through the duct configured as a hollow profile. The outwardly sealed duct accommodates and protects control components in the shape of e.g. connecting lines so as to again prohibit contamination.

In preferred specific embodiments at least one hollow profile shows inclined roof surfaces in its top face (when mounted). The configuration of the top face is such that any dirt particles arriving slip down automatically due to the inclination and in any case do not accumulate. The angle of the inclined roof surfaces to the horizontal is preferably larger than 20° or 30° and may be 45° or 60° or the like.

In all the configurations it is preferred for the apparatus to comprise at least one bag feed, at least one product feed, at least one bag closing station and at least one bag discharge. The bag feed may be configured as a bag forming station or a bag manufacturing station and may serve to manufacture bags from tubular sheets.

The apparatus according to the invention allows to comply with high and highest hygienic standards. At the same time the apparatus is simple in structure. The apparatus allows easy cleaning. The interior of the hollow profile allows to use and install standardised and thus cost-effective control components since they do not need to comply with the high hygienic standard levels.

The interior of the hollow profile or the hollow profiles can accommodate the feed and discharge lines for the pneumatics (pneumatic cylinder) protected from contamination.

The control component installed in the hollow profile may also be a valve or a drive. Other electric or pneumatic or other cables may be mounted (together).

The outlet air of one or more pneumatic cylinders may be at least partially outlet in the interior of the hollow profile (or the hollow profiles). This reduces noise emission. Moreover, excess pressure is generated in the hollow profiles or in the machine frame. In the case of rotary machines the rotating hollow profiles, which are preferably configured as a hub or spider, are optionally also supplied with compressed air so as to generate excess pressure where it is useful. Air supply from the stationary to the rotary portion of a rotating device may be provided by a hollow shaft. The hollow shaft is in particular connected with the stationary portion by means of a slip ring assembly for example for electric signals and/or a rotary bushing for example for compressed air.

Another apparatus according to the invention serves to fill bulk goods into bags. The apparatus comprises a frame structure or support structure and at least one filling spout accommodated in particular on the frame structure or support structure. For filling, a bag is appended to the filling spout. The bag is preferably retained at the filling spout by at least one bag holder. The frame structure or support structure comprises at least one hollow profile. At least one air outlet of a pneumatic component is provided in the hollow profile for bleeding off outlet air from the at least one pneumatic component in the hollow profile.

Preferably at least one pneumatic component is configured as a pneumatic cylinder. The frame structure is in particular configured as a support structure and serves to retain at least one filling spout.

An air relief of pneumatic components in a hollow profile (or in multiple hollow profiles) or in the frame structure of the apparatus allows to achieve considerable reduction in sound and noise pollution. Acoustic emissions from an apparatus equipped e.g. with pneumatic grippers or bag holders are considerably reduced. Noise pollution in the ambience can be reduced.

A hollow profile is preferably provided with an outwardly outlet. A silencer or silencing elements may be provided in the hollow profile or on the outlet to further reduce noise pollution. In all the configurations any excess air not required above the required pressure level may be emitted outwardly through the cable trays to the ambience (in particular including external of the workshop).

In all the configurations it is preferred to set an excess pressure in operation of at least 0.5 mbar in the interior of the hollow profile. An excess pressure is set in the interior of the frame structure or of the hollow profile in particular between about 0.5 mbar and 30 mbar and preferably between 0.5 mbar and 18 mbar relative to the ambience. Usually an excess pressure of no more than 5 mbar or 10 mbar is set.

A specific embodiment of this other apparatus according to the invention may in particular also show all of the features of claim 1. Preferred specific embodiments show features of at least one (or some or nearly all or all of the) subclaims 2 through 19. In preferred specific embodiments this apparatus may show individual or all of the features of all the other previously described configurations.

Further advantages and features of the present invention can be taken from the exemplary embodiment which will be described below with reference to the enclosed figures.

DETAILED DESCRIPTION OF PREFERRED EMBODIMENTS OF THE INVENTION

Figure 1:
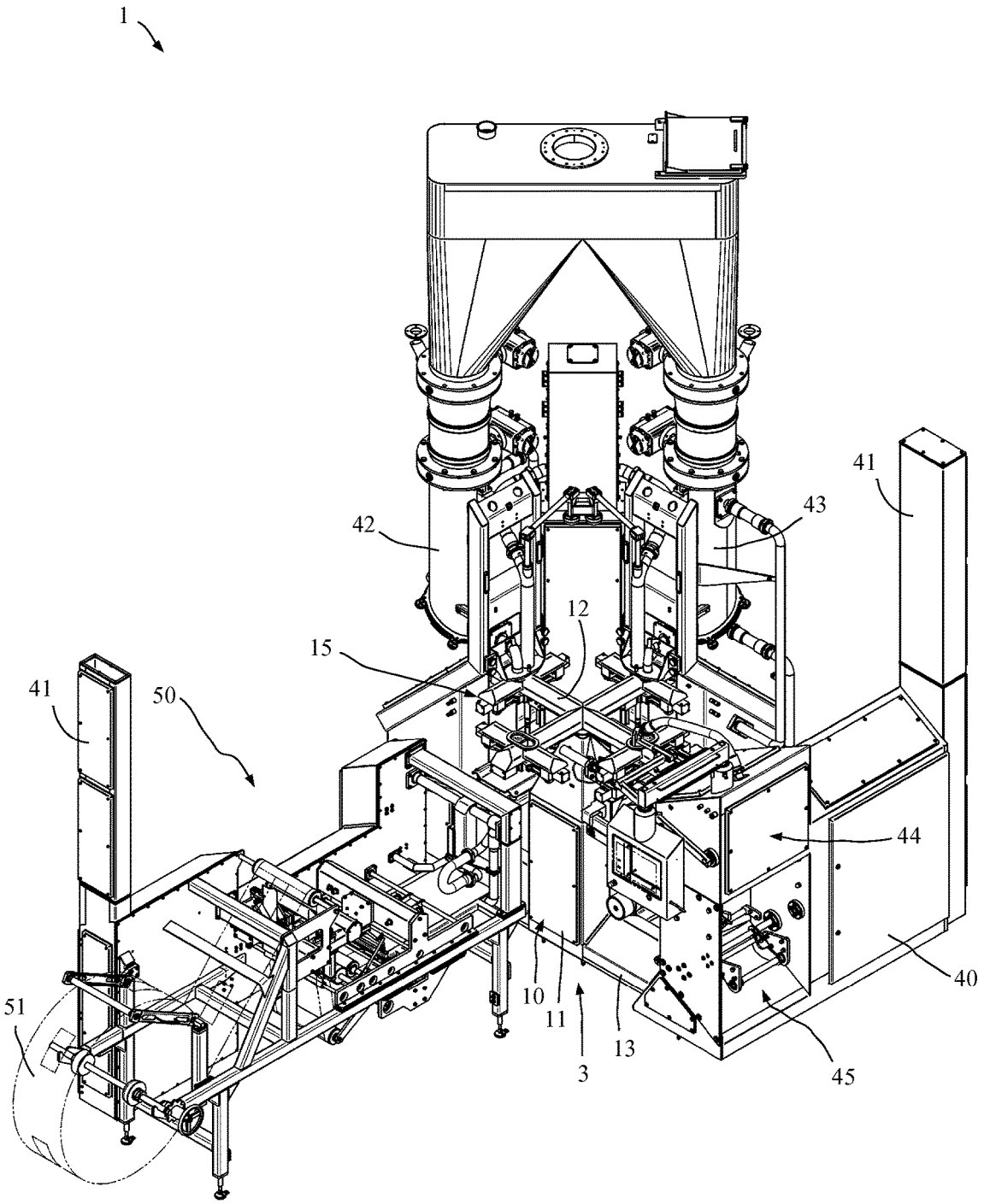
FIG. 1 a schematic perspective view of an apparatus according to the invention.

With reference to the accompanying Figures an apparatus 1 according to the invention will now be discussed which may be configured as a complete FFS system and may comprise a bag feed 50 on which individual open-mouth bags 2 are formed from a film roll 51. It is also possible to feed individual, prefabricated bags. The apparatus 1 may be set up in a separate room. In the cable and hose ducts 41 the connecting lines are protected and guided outwardly toward control cabinets in a room above the apparatus 1. In this place the hygienic and optionally explosion protection conditions required for the apparatus 1 need not be met.

The apparatus 1 is configured as a rotary system and comprises a support structure 3 and provided thereat, a rotary rotating device 15 on which presently four filling spouts 4 are formed, each of which serves to accommodate a bag or open-mouth bag. In a filling station for high speed flow 42 the majority of the intended filled foodstuff is filled through the bag holders 4 into the open-mouth bag 2. Presently the filling process is performed by differential weighing. It is also possible to perform the bagging process according to the gross method or the net method, wherein the gross method provides for weighing the bag during the filling process and the net method provides for first measuring the intended filled bulk goods and thereafter filling it into the bag.

The filling station for high speed flow 42 is followed during the next index by the filling station for low speed flow 43. The filling stations 42 and 43 may be provided with compacting devices which compact the bulk goods in the open-mouth bag 2 prior to, during, or after the pertaining filling process. After the filling station for low speed flow 43 the following bag closing station 44 closes the still open top of the open-mouth bag, followed by the bag discharge 45.

The support structure 3 comprises multiple hollow profiles 10, 11, 12 and 13, in which control components 20 are disposed. At least one of the hollow profiles 10 is equipped with an air outlet 8 in its interior so that the interior of the profile 10 can be exposed to excess pressure relative to the ambience.

Excess pressure in a hollow profile 10 reliably prevents the entry of particles or dirt into the interior of the hollow profile since an air flow exits through any gaps or exit apertures of the hollow profile 10, which is actually sealed, which prohibits the entry of dust or dirt into the interior of the hollow profile 10.

Figure 2:
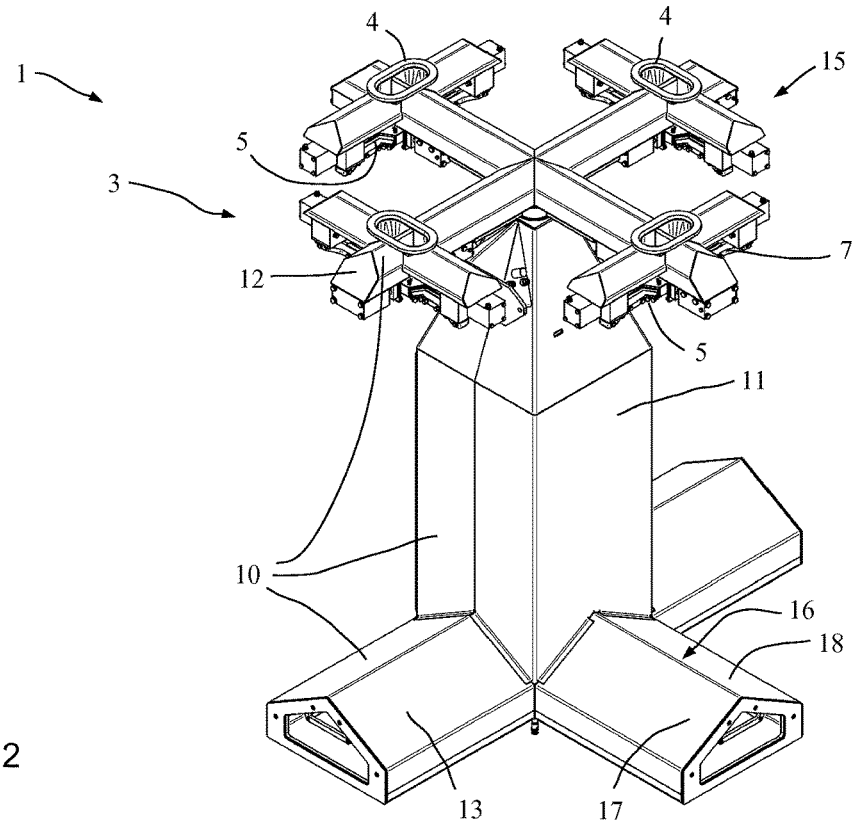
FIG. 2 a schematic perspective view of the support structure of the apparatus in FIG. 1.

FIG. 2 shows an enlarged schematic perspective view of the support structure 3 in FIG. 1. The support structure 3 overall may be used as an autonomous apparatus 1. The support structure 3 is as a rule mounted stationary on the floor and may be provided with one or more ducts 13 configured as hollow profiles. In the ducts 13 disposed at floor level, connecting lines for compressed air or electric connecting lines may be fed under protection.

The support structure furthermore comprises a central and presently vertically oriented hollow profile 11 as a supporting unit. The supporting unit 11 supports the rotating device 15 which presently shows four filling spouts 4 rotating around a central axis.

The rotating device 15 again comprises multiple hollow profiles 12 connecting the central rotation axis with each of the filling spouts 4. The hollow profiles 12 of the rotating device 15 also serve to accommodate connecting lines to supply compressed air to the pneumatic cylinders 7 of the bag holders 5, 6 of the filling spouts 4.

It is also possible to provide electric drives for the bag holders 5, 6. In this case electric connecting lines for driving the bag holders 5, 6 are mounted in the hollow profiles 12 of the rotating device 15. Moreover further conduits may be mounted in the hollow profiles 12. The pneumatic or electric lines in the hollow profiles 12 are control components 20 and are safely protected against contamination in the pertaining hollow profiles 12.

The central and presently vertically oriented hollow profile 11 as a supporting unit supports the rotating device 15 and thus also the filling open-mouth bags 2 during the filling process. However, the supporting unit 11 or the central hollow profile 11 shows outer dimensions which are larger than required just for the stability of the support structure 3. The reason is, among other things, that control components 20 are accommodated in the interior of the profile 11 which will be described in detail when discussing FIG. 4.

As can be clearly seen in FIG. 2, the top faces of each of the hollow profiles 10 through 13 are formed slanted or roof-like. The top faces 16 of the hollow profiles 13 are each provided with inclined roof faces 17, 18 so that any dirt particles falling down from above tend to be forwarded downwardly. The top faces of the hollow profiles 12 of the rotating device 15 also show inclined roof faces so as to reduce any dust and dirt deposits.

Figure 3:
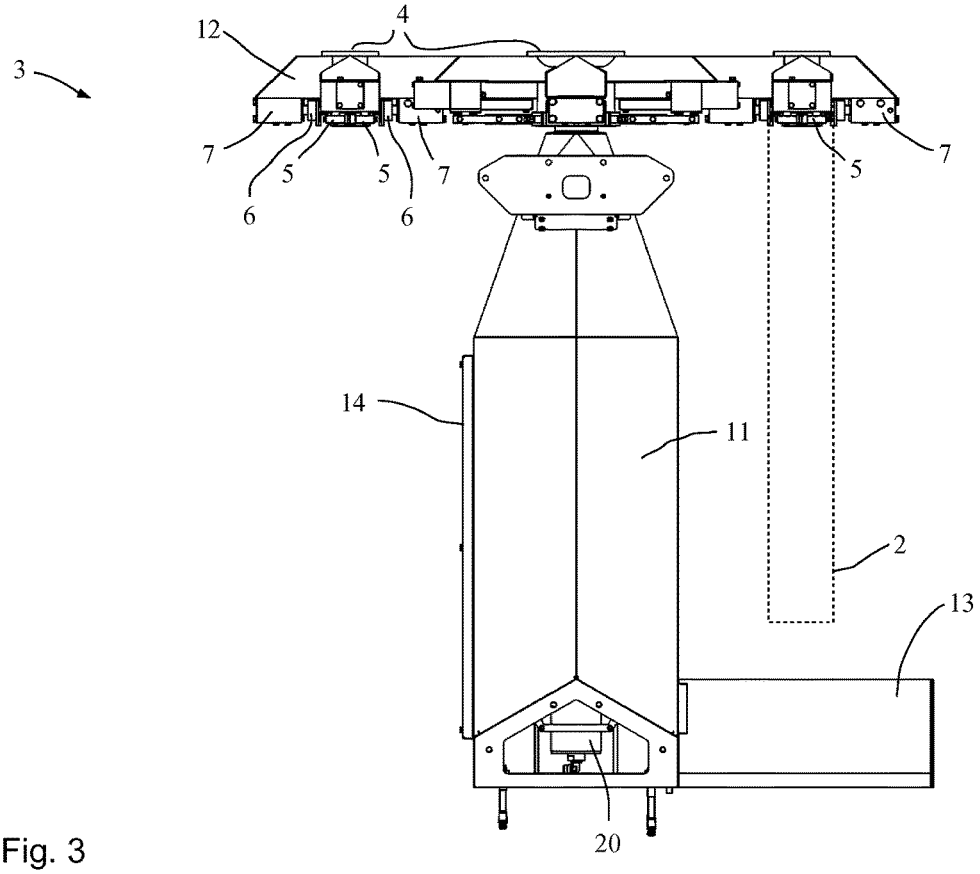
FIG. 3 a side view of FIG. 2.

FIG. 3 shows a side view of the support structure 3 in FIG. 2 with a service door 14 recognizable at the vertical hollow profile 11 as a supporting unit which may be opened during mounting or later during servicing to service or exchange control components 20 in the interior of the profile 11. FIG. 3 schematically shows an open-mouth bag 2 appended on a filling spout 4. One of the control components 20 is recognizable in the interior of the profile 11 through the interior of the hollow profile 13 as a duct at the bottom end of the hollow profile 11 as a supporting unit.

Figure 4:
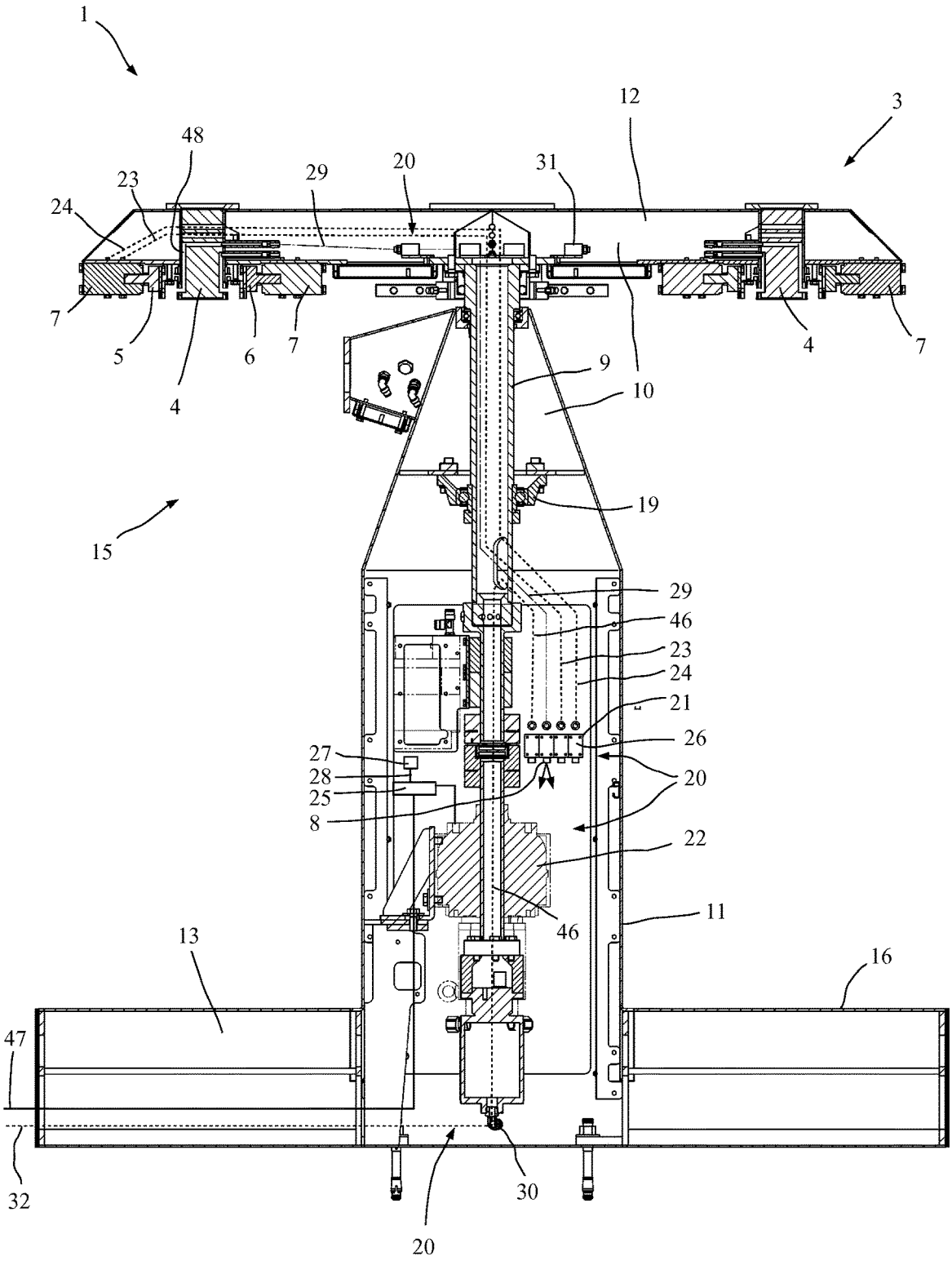
FIG. 4 a section of the illustration in FIG. 2.

FIG. 4 shows a sectional side view of the support structure 3, wherein each of the hollow profiles 10 through 13 is shown in section.

Pneumatic connecting lines 23 and also electric connecting and control lines 24 can be routed through the hollow profiles 13 into the support structure 3. The protected accommodation in the duct or the hollow profile 13 allows to reliably prevent contamination of the individual lines 23, 24, so as to eliminate cleaning each of the lines 23, 24 in normal operation.

The interior of the vertical hollow profile 11, which serves as a supporting unit for the rotating device 15, accommodates several control components 20. Thus the electric motor is accommodated in the interior of the hollow profile 11 as a drive 22 of the rotating device 15. In this case the electric motor 22 is controlled by the control device 25 which is also disposed in the interior of the hollow profile 11. It is possible to dispose in the interior of the profile 11 for example a sensor device 27 such as a pressure sensor to capture the internal pressure prevailing in the interior of the hollow profile 11. The pressure sensor or other sensors may be connected with the control device 25 through sensor cables 28.

The compressed air is supplied by the conduit 32 through the hollow profile of the duct 13. The compressed air supply is guided at the rotary bushing with the slip ring 30 by the conduit 46 through the hollow shaft 9 to the co-rotating valve island 26, supplying compressed air to the valve island 26. Each of the pneumatic cylinders 7 is controlled by two control valves 21 and may be shifted to one or the other end position by compressed air.

Each of the pneumatic cylinders 7 is connected through two conduits 23 and 24. Each of the conduits 23 and 24 serves as a supply air line and air outlet pipe, depending on the switched state of the pertaining control valve. The compressed air supplied through a conduit is fed back after switching through the same conduit after switching and may then be discharged through a control valve, which is then open, as outlet air through an air outlet into the interior of the hollow profile.

Power is supplied through the conduit 47. Although further conduits for controlling are provided they are not further illustrated or denoted in detail.

The internal pressure is preferably controlled such that the internal pressure in operation is as a rule higher than the atmospheric ambient pressure. A pressure gradient from the interior of the hollow profile outwardly reliably prevents entry of dirt and dust into the interior of the hollow profile 11.

Furthermore bearings 19 for the hollow shaft 9 of the rotating device 15 are fastened in the interior of the supporting unit configured as a hollow profile 11. Moreover at least one valve island 26 with multiple pneumatic control valves 21 is accommodated therein which select the different bag holders 5, 6 of the pertaining filling spouts 4. Pneumatic compressed air lines 23 and 24 leading to each of the bag holders are provided. The compressed air is fed back through these air lines 23, 24 and discharged as outlet air 8 at the co-rotating valve island 26 in the interior of the hollow profile 10 when the bag holder 5, 6 is switched to and from retaining and opening. Alternatively a central compressed air supply is provided and the hollow profiles 12 of the rotating device 15 accommodate control valves which select the pneumatic cylinders 7 of the bag holders 5, 6.

The outlet air of the pneumatic cylinders 7 is presently fed back and delivered in one or more of the hollow profiles 10 through one or more air outlets 8. This reduces noise pollution in the ambience of the apparatus 1. Moreover, excess pressure thus builds up in the profiles 10 to 13 so that no further additional air needs to be delivered in the profiles 10 to 13 to maintain the required or desired excess pressure in the interior of the hollow profile 10 to 13 during operation.

An air outlet 8 is schematically shown in FIG. 4 at the vertical hollow profile 11 as a supporting unit for the rotating device 15. The air outlet 8 releases the air of one or more grippers 5, 6 after they had been activated.

A partition wall is configured in the filling spout. Air lines are guided through the interior of the partition wall through which compressed air is supplied to the pneumatic cylinders of the bag holders 6. Moreover, compressed air is fed through the conduit 29 to the filling spout where it can exit outwardly toward the bag holder 6 through a bore 48 provided therein as a bag recognition.

When a bag is correctly placed on the filling spout, the opening is closed and the generated excess pressure is sensed. Only then is the filling process enabled. Preferably the bag wall is recognized by the bag recognition 48 in two opposite walls.

Figure 5:
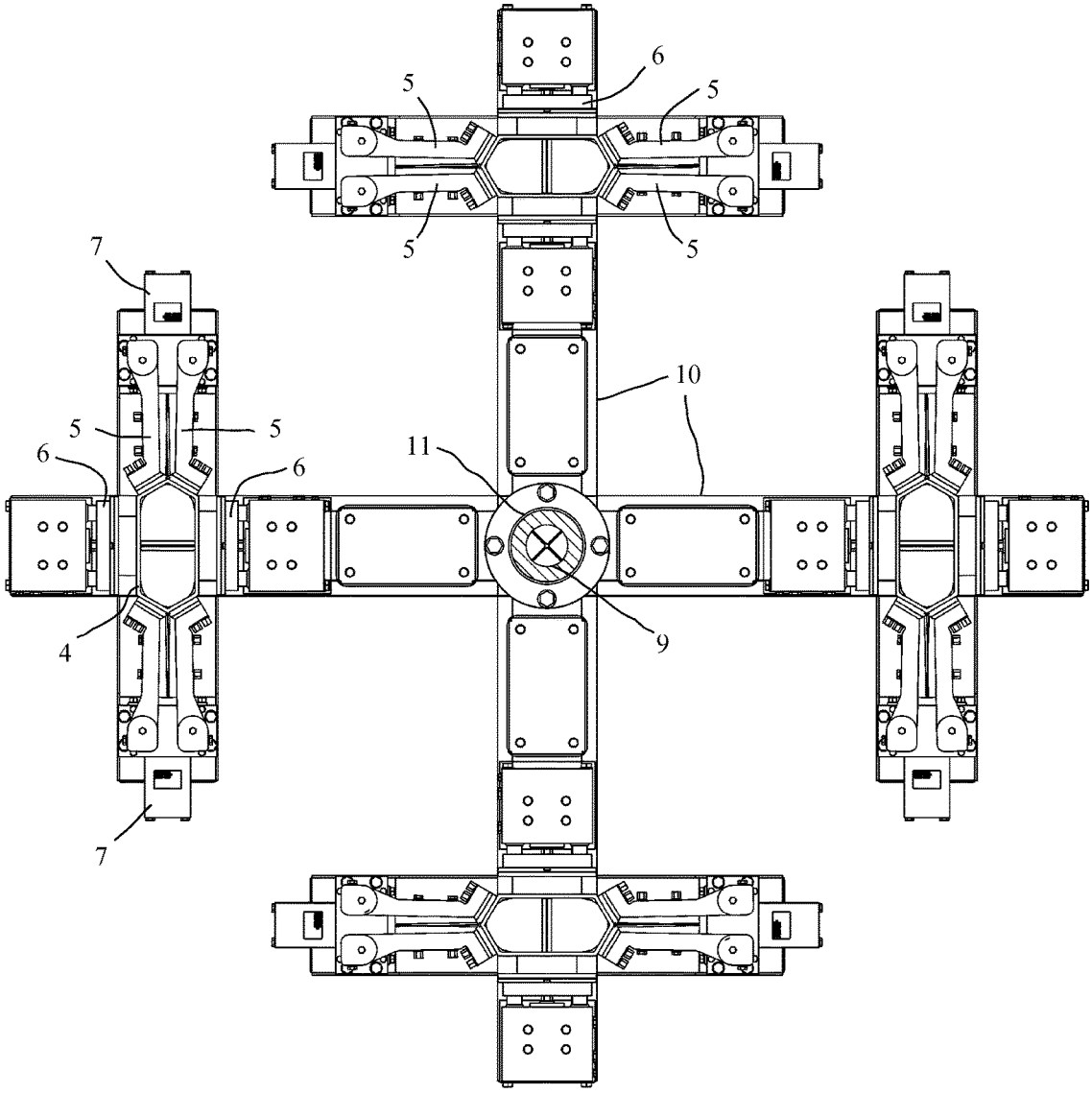
FIG. 5 a cross-sectional bottom view of FIG. 2.

FIG. 5 finally shows a sectional bottom view of the rotating device 15 wherein the pivotable grippers 5, 6, each of which is selected by a pneumatic cylinder 7, and the presently hexagonal bag holder 4 from below are recognizable. The connecting lines are supplied through the hollow profile 10. Air and current are supplied through the hollow shaft 9 around which the rotating device 15 is rotatably mounted.

The invention provides an advantageous apparatus 1 wherein control components 20 such as connecting lines and pneumatic control valves are accommodated in the interior of the hollow profile 10. This allows to jointly mount multiple conduits in the interior of the hollow profile. Moreover, cost-effective standard components may be used as an electric drive or a pneumatic valve which do not need to comply with the raised hygiene requirements for bagging foodstuffs.

According to this basic configuration, other assemblies such as a lifting device for a vibrating table which is lifted during filling from below beneath the bag, can in analogy be configured with interior drive and control components.

LIST OF REFERENCE NUMERALS

| | |
|---|---|
| 1 | apparatus |
| 2 | bag |
| 3 | support structure |
| 4 | filling spout |
| 5 | bag holder |
| 6 | bag holder |
| 7 | pneumatic cylinder |
| 8 | air outlet |
| 9 | hollow shaft |
| 10 | hollow profile |
| 11 | hollow profile, supporting unit |
| 12 | hollow profile |
| 13 | hollow profile, duct |
| 14 | door |
| 15 | rotary device |
| 16 | top face |
| 17 | roof face |
| 18 | roof face |
| 19 | bearing |
| 20 | control component |
| 21 | control valve |
| 22 | drive |
| 23 | line, conduit |
| 24 | line, conduit |
| 25 | control device |
| 26 | valve island |

-continued

| | |
|---|---|
| 27 | sensor device |
| 28 | line, conduit |
| 29 | line, conduit |
| 30 | slip ring |
| 31 | compressed air manifold |
| 32 | line, conduit |
| 40 | supply station |
| 41 | cable and hose duct |
| 42 | product feed |
| 43 | product feed |
| 44 | bag closing station |
| 45 | bag discharge |
| 46 | line, conduit |
| 47 | line, conduit |
| 48 | bag recognition |
| 50 | bag feed |
| 51 | film roll |

The invention claimed is:

1. An apparatus (1) for filling bulk goods into bags (2), the apparatus (1) comprising:

a support structure (3); and at least one filling spout (4) accommodated on the support structure (3) to which a bag (2) is appended for filling, wherein the bag (2) is retained on the filling spout (4) in a hanging position by at least one bag holder with two gripping elements (5, 6);

wherein the support structure (3) comprises a plurality of hollow profiles (10, 11, 12, 13) with a control component (20) at least partially accommodated and protected from contamination therein, each of said plurality of hollow profiles being a hollow structure which defines an interior space;

at least one of said plurality of hollow profiles (i) having an air outlet (8) which provides, in operation, an air pressure in the interior space of the hollow profile that is higher than an ambient air pressure in order to protect the interior space of the hollow profile from contamination, (ii) having disposed therein at least one valve island (26) having multiple separately controlled control valves (21) as control components, and (iii) having disposed therein a sensor device (27) with at least a pressure sensor as a control component;

wherein an air outlet pipe (29) of a pneumatic cylinder (7) opens into the interior space of at least one of said plurality of hollow profiles;

at least one of said plurality of hollow profiles being a central hollow profile (11); an axial hollow shaft (9) extending axially within the interior space of the central hollow profile (11) and supporting a spout device comprising the filling spout (4);

wherein compressed air and/or electric current are supplied through the interior of the axial hollow shaft (9) to the spout device.

2. The apparatus according to claim 1 wherein the hollow profile having the air outlet (8) is sealed.

3. The apparatus according to claim 1 wherein a control device (25) as a control component is disposed in the hollow profile having the air outlet (8).

4. The apparatus according to claim 1 wherein at least one connecting line (23, 24) is accommodated as a control component in the hollow profile having the air outlet (8), wherein the at least one connecting line (23) is configured electric, pneumatic or hydraulic.

5. The apparatus according to claim 4 wherein at least one sensor cable (28) is accommodated in the hollow profile having the air outlet (8).

6. The apparatus according to claim 1 wherein the at least one bag holder (5, 6) is fastened to at least one of said plurality of hollow profiles.

7. The apparatus according to claim 1 wherein the at least one bag holder (5, 6) is operative via a pneumatic cylinder (7) and/or electrically.

8. The apparatus according to claim 1, wherein the spout device is a rotating device (15) with a plurality of filling spouts (4) disposed thereat, wherein the rotating device (15) comprises multiple hollow profiles (12) rotatable relative to the central hollow profile (11).

9. The apparatus according to claim 1 wherein a bearing and/or a drive motor (22) is disposed in the central hollow profile (11).

10. The apparatus according to claim 1 wherein a slip ring (30) and/or a compressed air manifold (31) and/or a rotary bushing for a pneumatic or hydraulic fluid is accommodated in the central hollow profile (11).

11. The apparatus according to claim 1 wherein the central hollow profile (11) is connected with a supply station (40) through at least one duct (13) configured as a hollow profile.

12. The apparatus according to claim 1 wherein the hollow profile having the air outlet (8) comprises inclined roof faces (17, 18) on a top face (16) of the hollow profile.

13. The apparatus according to claim 1, wherein the gripping elements are pneumatic gripping elements.

14. The apparatus according to claim 1, wherein the bag (2) is an open-mouth bag.

15. The apparatus according to claim 1, wherein the hollow profile having the air outlet (8) is the central hollow profile (11), wherein the central hollow profile (11) is sealed.

16. The apparatus according to claim 1, wherein an upper portion of the axial hollow shaft (9) extends within an upper portion of the central hollow profile (11).

17. The apparatus according to claim 1, wherein an upper portion of the axial hollow shaft (9) supports the spout device.

18. An apparatus (1) for filling bulk goods into bags (2), the apparatus (1) comprising:

a central hollow profile (11);

a spout device (15) supported by the central hollow profile (11);

at least one filling spout (4) formed on the spout device (15) to which a bag (2) is appended for filling, wherein the bag (2) is retained on the filling spout (4) in a hanging position by at least one bag holder (5, 6);

an axial hollow shaft (9) extending axially within an interior space of the central hollow profile (11), the spout device (15) being mounted to the axial hollow shaft (9);

an air outlet (8) provided in the central hollow profile (11), wherein in operation, the air outlet (8) provides an air pressure in the interior space of the central hollow profile (11) that is higher than an ambient air pressure in order to protect the interior space from contamination;

a control component (20) at least partially accommodated in the central hollow profile (11) and protected from contamination therein;

a plurality of hollow profiles (10, 11, 12, 13) including the central hollow profile (11), the bag holder comprises pneumatic gripping elements (5, 6), and an air outlet pipe (29) of the pneumatic gripping elements (5, 6) opens into an interior space of at least one of said plurality of hollow profiles (10, 11, 12, 13) to reduce acoustic emissions.

19. The apparatus (1) according to claim 18, wherein the axial hollow shaft (9) includes an inner space that extends within the interior space of the central hollow profile (11).

20. The apparatus (1) according to claim 18, wherein at least one connecting line (23, 24) is accommodated as a control component in the axial hollow shaft (9), wherein the at least one connecting line (23, 24) is electric, pneumatic, or hydraulic.

* * * * *